United States Patent [19]

Uchida

[11] 4,116,346

[45] Sep. 26, 1978

[54] QUICK COUPLER

[75] Inventor: Tomio Uchida, Sapporo, Japan

[73] Assignee: Caterpillar Mitsubishi Ltd., Tokyo, Japan

[21] Appl. No.: 763,786

[22] Filed: Jan. 31, 1977

[30] Foreign Application Priority Data

Feb. 24, 1976 [JP] Japan ..... 51-018413

[51] Int. Cl.[2] ..... E02F 3/81

[52] U.S. Cl. ..... 214/145 A; 74/520; 172/273

[58] Field of Search ..... 214/145 A; 172/272, 172/273; 74/520

[56] References Cited

U.S. PATENT DOCUMENTS

| | | | |
|---|---|---|---|
| 2,576,703 | 11/1951 | Sheehan, Jr. | 74/520 |
| 3,818,551 | 6/1974 | Coughron, Jr. | 214/145 A |
| 3,935,953 | 2/1976 | Stedman | 214/145 A |
| 4,013,182 | 3/1977 | Pratt et al. | 214/145 A |

FOREIGN PATENT DOCUMENTS

| | | | |
|---|---|---|---|
| 1,279,491 | 11/1961 | France | 214/145 A |

OTHER PUBLICATIONS

"16 Latch, Toggle and Trigger Devices" Product Engineering, May 1957, by Sigmund Rappaport, pp. 200 and 201.

*Primary Examiner*—Albert J. Makay
*Assistant Examiner*—Ross Weaver
*Attorney, Agent, or Firm*—Charles E. Lanchantin, Jr.

[57] ABSTRACT

A quick coupler for attaching and detaching an implement to and from a vehicle equipped with a lift arm and a tilt link includes a hitch having a lower supporting assembly with a lower link member and being pivotally connected to the lift art, and an upper supporting assembly with an upper link member and being pivotally connected to the tilt link, the lower link member being pivotally connected to the upper link member and being movable with respect thereto between an over-center locking position and an angularly collapsed and disengaged position, and having mechanical spring means urging the lower and upper supporting members together, and a hook arrangement secured to the implement and having a lower hook portion and an upper hook portion respectively receiving the lower and upper supporting assemblies therein with the mechanical spring means maintaining the upper and lower link members at said over-center locking condition.

5 Claims, 12 Drawing Figures

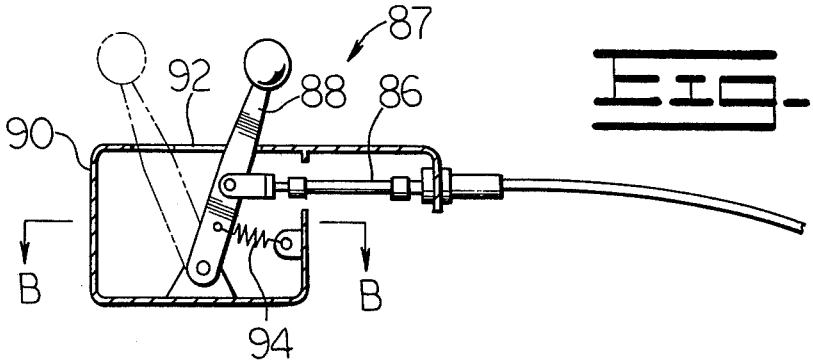
FIG. 7A
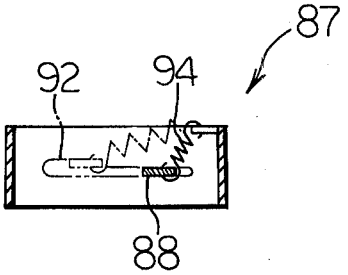
FIG. 7B
FIG. 8
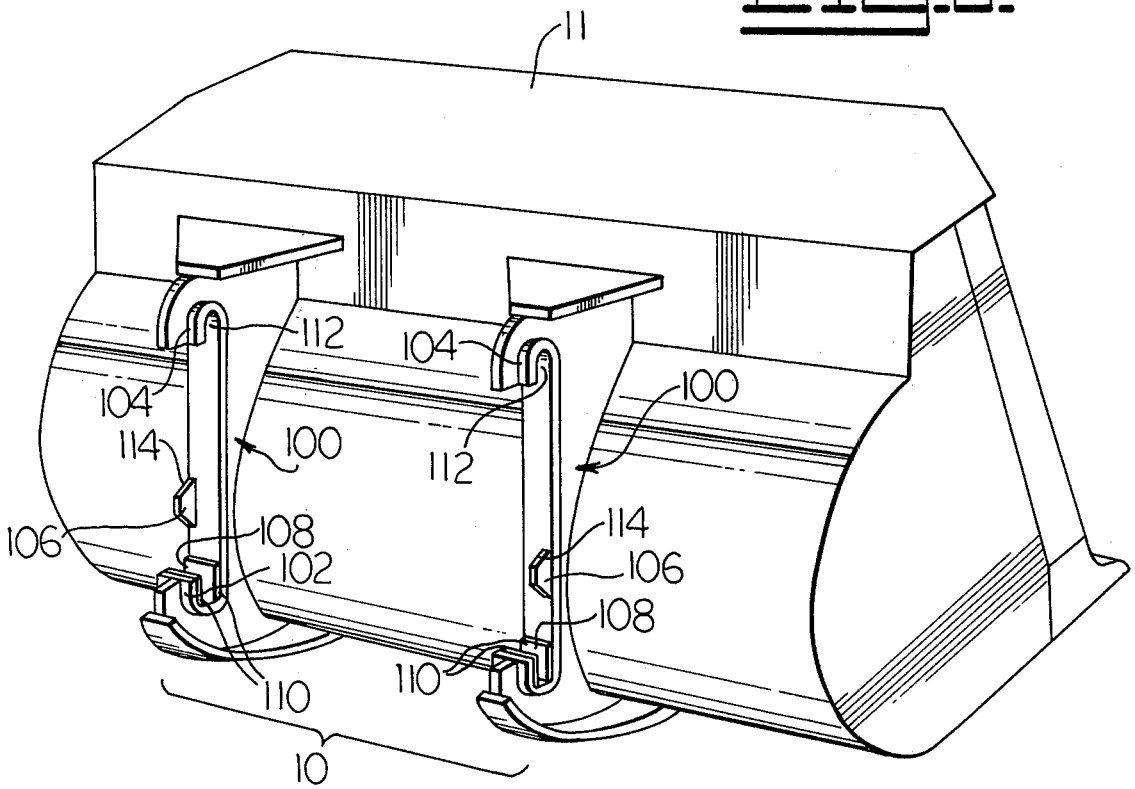

Fig. 10A.
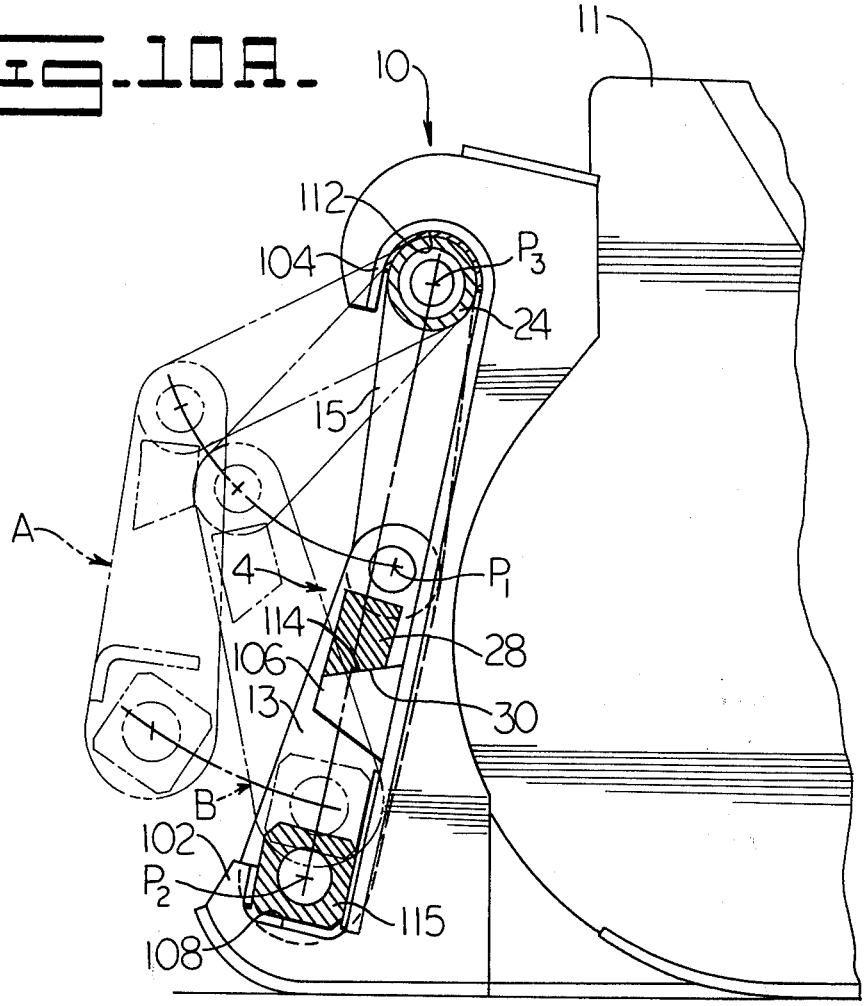
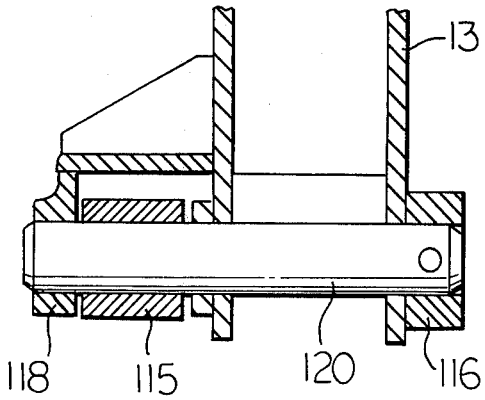
Fig. 10B.

QUICK COUPLER

BACKGROUND OF THE INVENTION

This invention relates to a quick coupler, and more particularly to a quick coupler for attaching and detaching an implement to and from a vehicle equipped with a lift arm and a tilt link.

An earthmoving vehicle equipped with a lift arm and a tilt link, such as a wheel loader, may accomplish a multitude of operations by attaching various work implements thereto. For instance, a loader equipped with a bucket can load and transport earth or the like, while a loader equipped with a fork can load and transport material on pallets or pipes. In this way, a single earthmoving vehicle may be used for multiple purposes, if such implements may be conveniently attached to the vehicle, as required.

Quick disconnect and attachment mechanisms for securing various implements to a vehicle are exemplified by U.S. Pat. Nos. 3,243,066, issued Mar. 29, 1966 to C. W. Gardner, et al.; 3,417,886, issued Dec. 24, 1968 to C. F. Stuart; 3,760,883, issued Sept. 25, 1973 to B. D. Birk; 3,818,551, issued June 25, 1974 to F. J. Coughran, Jr.; and 3,935,953, issued Feb. 3, 1976 to R. N. Stedman.

However, such prior mechanisms have been generally unsatisfactory from the standpoint that most have been excessively complex and costly in construction. For example, some of the mechanisms have been subject to misalignment problems so that the powerably moved pins on the hitch have had difficulty extending into the openings provided therefor in the rear portions of the implement. In still other cases, hydraulically powered jacks have been utilized, which jacks are expensive in construction and which jacks require an associated control system and extensive hydraulic conduits which are subject to damage and inadvertent leakage during operation of the implement. In still other cases, an excessive amount of wear occurs between the hitch and the hook members on the implement with the result that the connecting joints therebetween become loose and less positive in operation.

SUMMARY OF THE INVENTION

The present invention is directed to overcoming one or more of the problems as set forth above.

According to the present invention, a quick coupler is provided for attaching and detaching an implement to a vehicle equipped with a lift arm and a tilt link, which coupler includes a hitch with a lower supporting assembly having a lower link member and being pivotally connected to the lift arm, an upper supporting assembly having an upper link member and being pivotally connected to the tilt link, the lower link member being pivotally connected to the upper link member and being movable with respect thereto between a first position and a second position, and having mechanical spring means urging the lower and upper supporting members together, and a hook arrangement secured to the implement and having a lower hook portion and an upper hook portion respectively receiving the lower and upper supporting assemblies and with the mechanical spring means maintaining the upper and lower link members in the second position.

BRIEF DESCRIPTION OF THE DRAWINGS

FIG. 7*a* is a diagrammatic elevational view showing a part of the locking mechanism of the quick coupler shown in FIG. 1, with portions thereof shown in section.

FIG. 7*b* is a diagrammatic and simplified cross sectional view taken along the line B—B of FIG. 7*a*.

FIG. 8 is a perspective view of the hook arrangement of the quick coupler shown in FIG. 1 as installed on the back of a loader bucket.

FIG. 10*a* is a diagrammatic and cross sectional view of an alternate embodiment quick coupler constructed in accordance with the present invention, and which may be compared with FIG. 9.

FIG. 10*b* is a fragmentary cross sectional view showing details of construction of the lower engaging member illustrated in FIG. 10*a*.

DESCRIPTION OF THE PREFERRED EMBODIMENT

Figure 1:
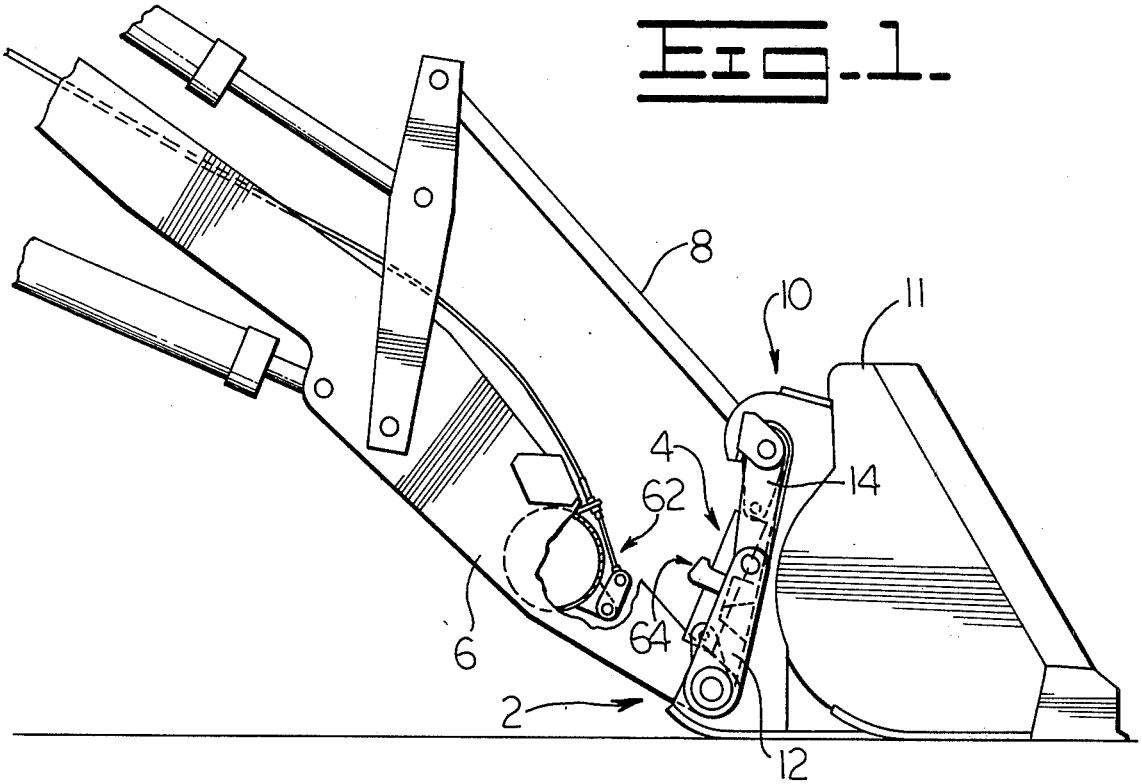
FIG. 1 is a side elevational view of a quick coupler constructed in accordance with the present invention.

For convenience, the terms such as "upper" or "upper portions" and "lower" or "lower portion" and used herein are to be considered with reference to FIG. 1, including the term "forward" meaning disposed at the right and the term "rearward" meaning disposed at the left when viewing such drawing.

Referring to FIG. 1, a quick coupler 2 constructed in accordance with the present invention includes a hitch 4 secured to the tip portions of a pair of lift arms 6 and the tip portions of a pair of tilt links 8 of an earthmoving vehicle such as a conventional wheel loader, and only a portion of which is shown. The coupler further includes a hook arrangement 10 secured to the back surface of an implement such as a bucket 11, which is thereby coupled to the vehicle.

Figure 2:
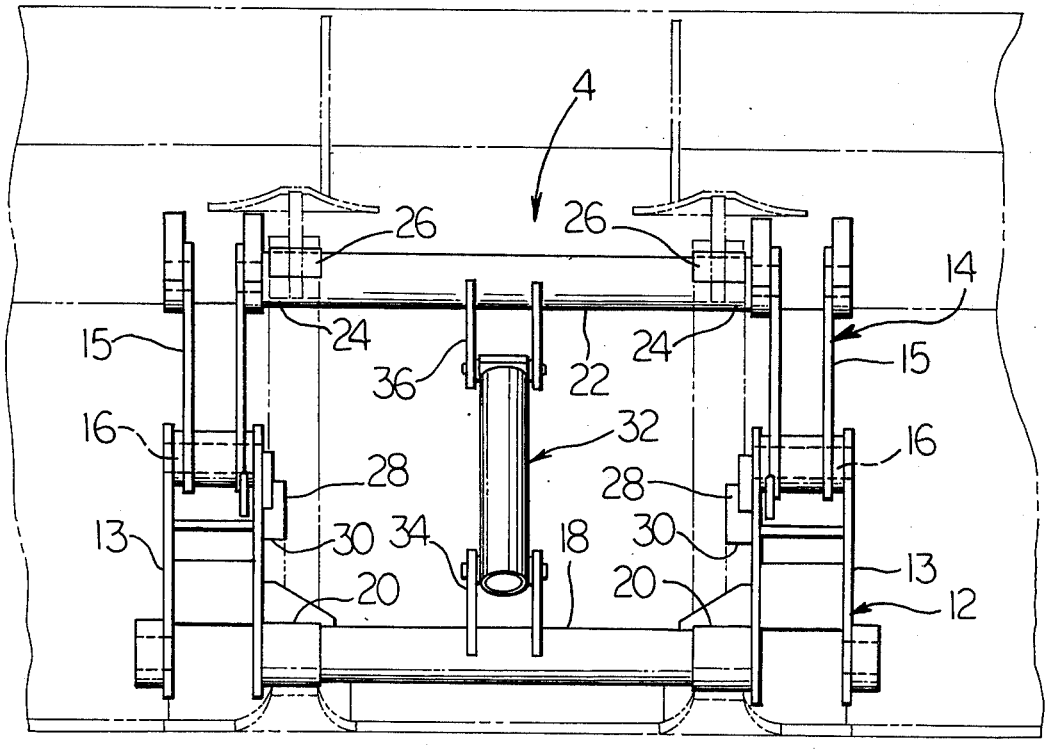
FIG. 2 is a rear view of the hitch portion of the quick coupler shown in FIG. 1, and showing a portion of the implement in phantom.
Figure 3:
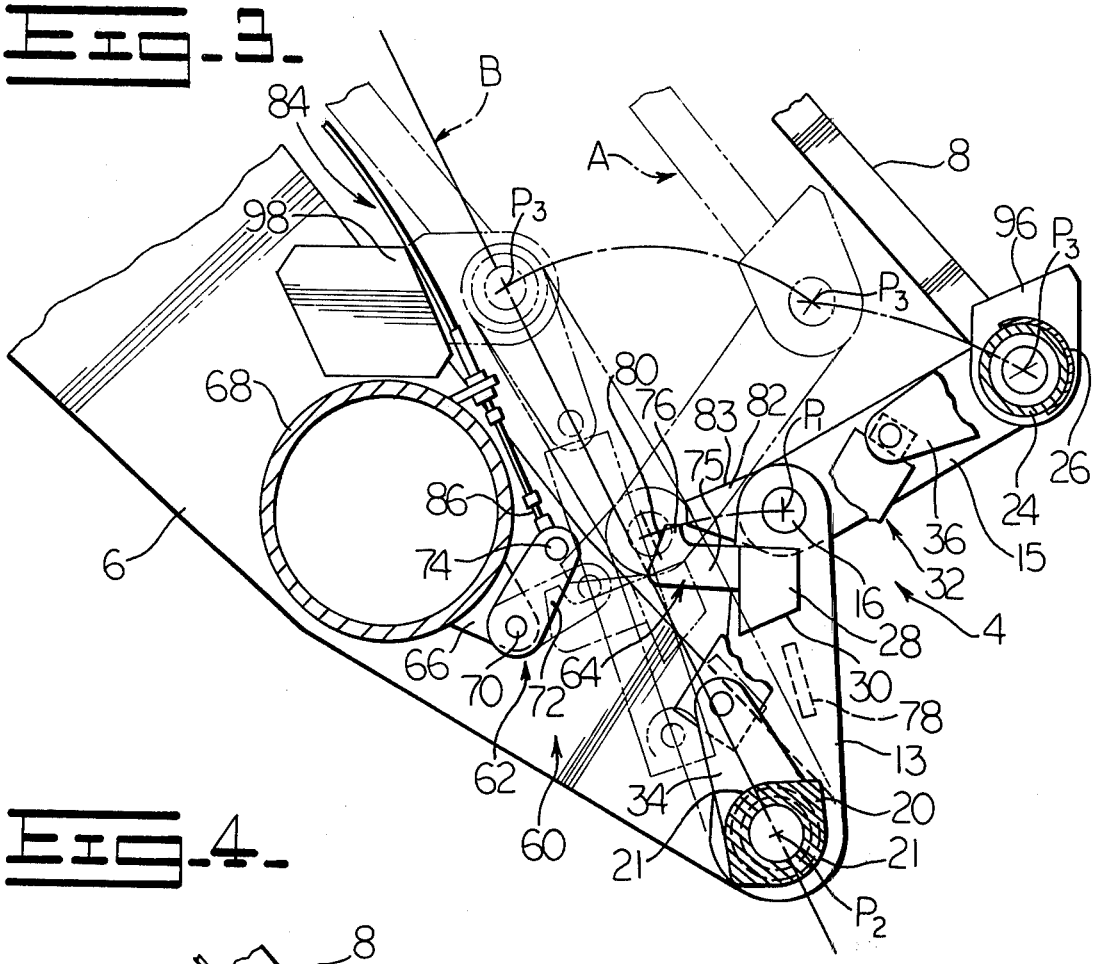
FIG. 3 is a cross sectional view diagrammatically illustrative of the operating conditions of the hitch and locking mechanism of the quick coupler shown in FIG. 1.
Figure 4:
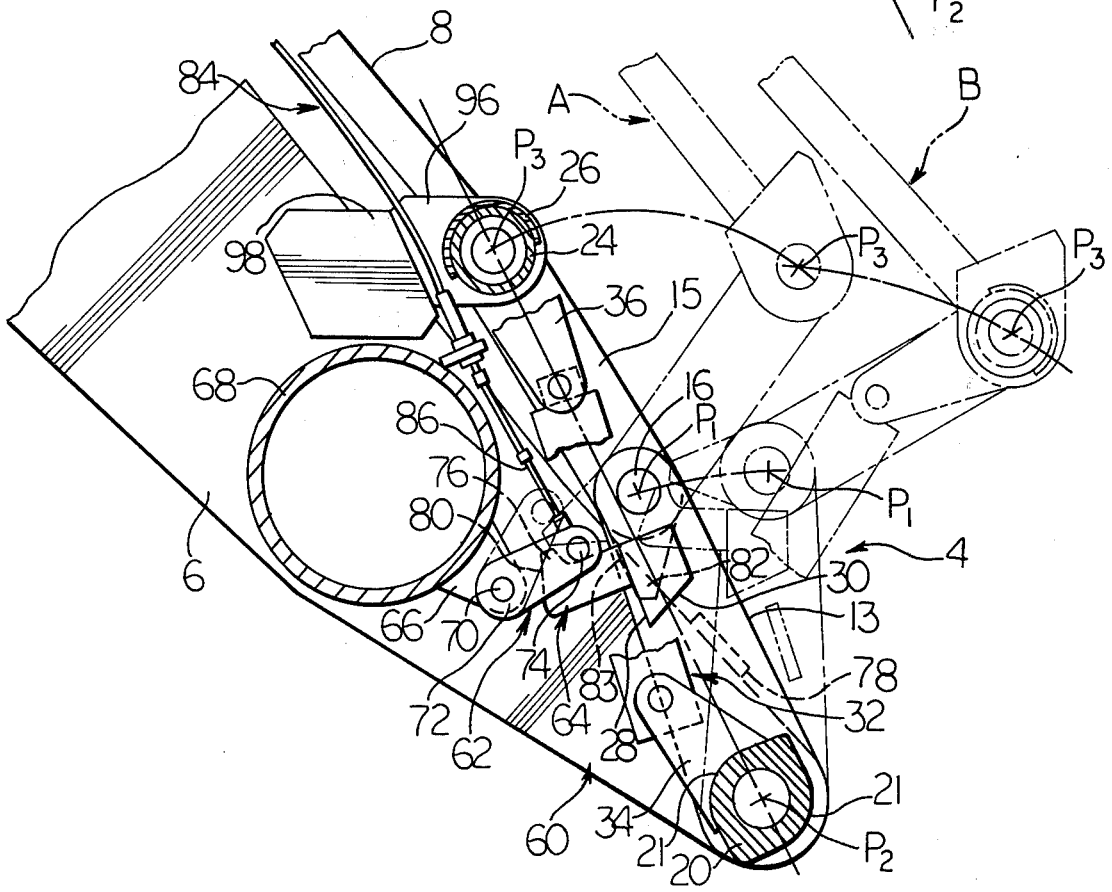
FIG. 4 is a cross sectional view diagrammatically illustrative of certain other operating conditions of the hitch and locking mechanism of the quick coupler shown in FIG. 1 which may be compared with FIG. 3.

Referring now to FIGS. 2, 3 and 4, the hitch 4 includes a lower supporting assembly 12 having a pair of lower link members 13 thereon whose lower end portions are pivotally connected to the tip portions of the lift arms 6. Also, the hitch includes an upper supporting assembly 14 having a pair of upper link members 15 thereon whose upper end portions are pivotally connected to the tip portions of the tilt links 8. The upper end portions of the lower link members are hinged to the lower end portions of the upper link members by a pair of pivot pins 16. A lower connecting member or cylindrical pipe 18 is interposed in rigid relation horizontally between the lower portions of the lower link members, and a lower engaging member 20 is secured to each of the opposite end portions adjacent to the lower link members. Such lower engaging members 20 are preferably made of an abrasion-resistant material. As best shown in FIGS. 3 and 4, the lower engaging members 20 are each of a substantially rectangular cross section, although a pair of diagonally opposite corners of the rectangle are formed so as to provide arcs of an inscribed circle of the aforesaid rectangle, such as is indicated by the arcuate corner surfaces 21. In a similar manner, an upper connecting member or cylindrical pipe 22 is interposed in rigid relation horizontally between the upper end portions of the upper link members 15. Opposite end portions of the upper horizontal member are disposed adjacent to the upper link members to provide a pair of upper engaging members 24 thereat. Preferably, an abrasion-resistant plate 26 is secured to the opposite end portions of the upper horizontal member in a manner to cover the upper half thereof. Moreover, a pair of intermediate engaging members 28 is secured to the inside of the lower link members 13, with each intermediate engaging member having an engaging surface 30 which is inclined rearwardly and downwardly as shown in FIGS. 3 and 4.

In addition, the hitch 4 includes a fully mechanically elastic spring means 32 whose one end is pivotally connected to a central portion of the lower horizontal member 18 and whose other end is pivotally connected to a central portion of the upper horizontal member 22 through lower and upper pairs of brackets 34 and 36, respectively. Such spring means exerts a continual tension load between the horizontal members for urging them toward one another and for enhancing safety of the quick coupler 2 when the hitch 4 is engaged with the hook arrangement 10.

Figure 5:
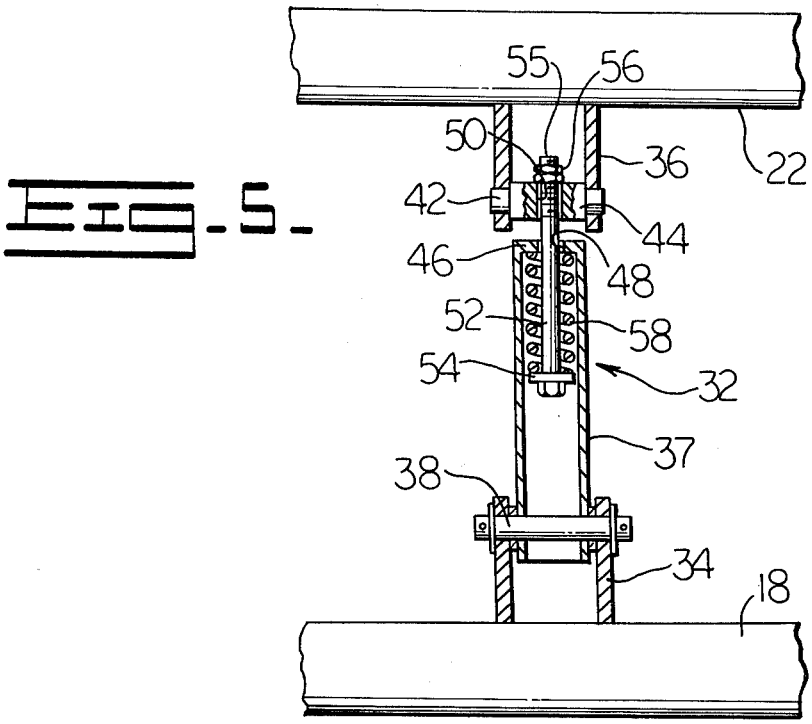
FIG. 5 is a cross sectional view illustrating details of the spring means shown centrally in FIG. 2.

Referring to FIG. 5, the spring means 32 includes a hollow member 37 which is pivotally connected to the lower brackets 34 by means of a pin 38, and is pivotally connected to the upper brackets 36 by means of a pin 42 and a block 44 integral therewith. The top of the hollow member is formed with an end plate portion 46 having a passage 48 extending through it at its center, and the block 44 is provided with the passage 50 extending through it which is in alignment with the passage 48. A shaft or bolt member 52 has a spring mount 54 at its lower end, and is formed with a threaded portion 55 at its upper end. The shaft member extends upwardly from within the interior of the hollow member, through the passages 48 and 50, and is retained in place at its upper end by a lock nut arrangement 56. A coiled compression spring 58 is confined between the end plate portion of the hollow member and the spring mount in circumscribing relation around the shaft member. This spring is compressed to a preselected amount in order to thereby apply a load in tension between the horizontal members 18 and 22, which tension is dependent upon the length of the compressed spring. Such tensile load is, accordingly, also applied to the lower and upper link members 13 and 15 respectively, and which are shown in FIG. 2. It is to be appreciated that the tensile load of the spring means may be modified by threadably adjusting the lock nut arrangement 56 and the compressed length of the spring.

Figure 6:
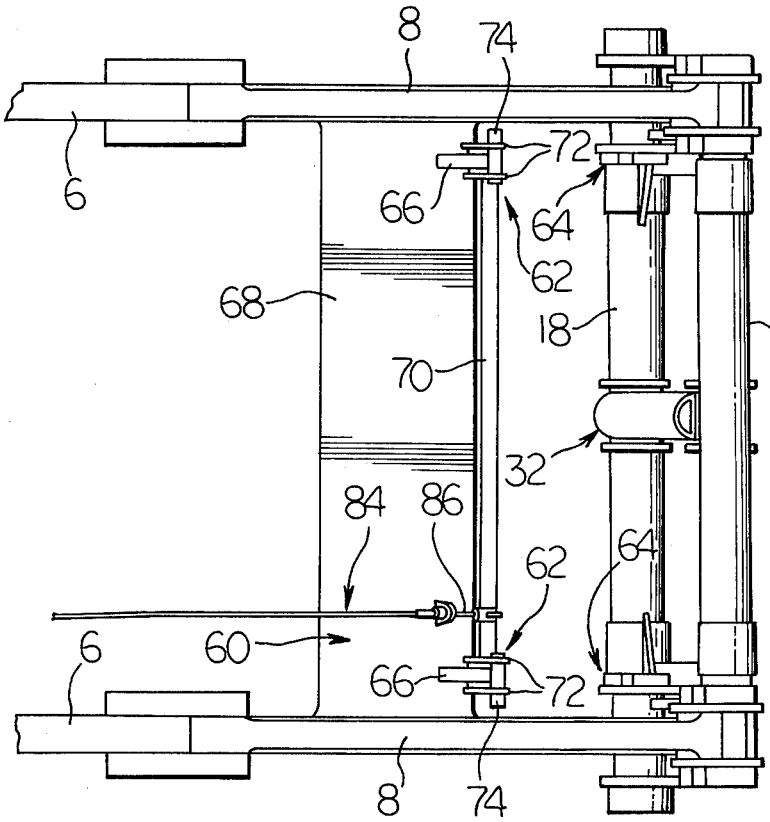
FIG. 6 is a plan view of the hitch and locking mechanism of the quick coupler shown in FIG. 1.

As shown in FIG. 3, 4 and 6, a locking mechanism 60 is shown which includes a first locking member 62 mounted on the lift arm 6, and a second locking member 64 secured to the lower link members 13 of the hitch 4 and arranged so that the second locking member may engage the first locking member.

As best shown in FIG. 6, the first locking member 62 is pivotally connected to a pair of laterally spaced apart brackets 66. These brackets are secured to a cross frame 68 which extends between the lift arms 6. Such locking member includes a rotary shaft member 70 which is transversely supported by the brackets in parallel with the cross frame. Secured to each end portion of the rotary shaft member is a pair of forwardly and upwardly inclined links 72, with the tip portions of each pair supporting an engaging pin member 74 therebetween in parallel with the rotary shaft member. As will be described hereinafter in greater detail, the first locking member 62 is pivotally movable between a first or engaged position as shown by the solid lines in FIG. 4, and a second or disengaged position as shown by the solid lines in FIG. 3.

In the instant example, each of the second locking member 64 includes a rearwardly extending hook 75 which is secured to the inner side of each pair of the lower link members 13, and which hooks are formed with an upwardly engaging projection 76 at their distal ends. Thus, the second locking members 64 are also pivotally movable between a first or engaged position wherein the lower link members 13 are rearwardly disposed relative to the lift arms 4 as shown in solid lines in FIG. 4, to a second or disengaged position wherein the lower link members are forwardly disposed as shown in solid lines in FIG. 3. The first position is positively effected by a pair of stop elements 78 which are individually secured to the pairs of lower link members 13, and which elements contact the top surfaces of the lift arms with rearward retraction thereof. When the first locking members 62 are also moved to their first positions as shown in solid lines in FIG. 4, then the projections 76 of the second locking members interlockingly engage the pin members 74 of the first locking members so that the lower link members of the hitch 4 may be positively secured in place as illustrated. In the event that the first locking members are in their first or forwardly disposed positions when the lower link members are rocked rearwardly, it is to be appreciated that the second locking members should preferably include an inclined tip cam surface 80 for engagement with the pin members 74 so as to pivotally rock the first locking members from their first positions rearwardly to their second positions.

The locking mechanism 60 is further provided with a pair of releasing members 82 which release the first locking member 62 from the second locking member 64, and hence release the locked condition of the lower link members 13, when the upper link members 15 are pivotally moved in a clockwise manner from the solid position shown in FIG. 4 to the phantom line position identified by the letter A. Particularly, in the embodiment shown, the releasing members 82 are individually secured in a depending and rearwardly projecting manner to the lower end of each pair of the upper link members. Thus, when the upper link members are rocked in a clockwise direction, a cam surface 83 defined on each of the releasing members contacts the pin members 74 to thereby pivotally move the links 72 rearwardly from their first to their second positions and to thus release the lower link members 13.

Preferably, the locking mechanism 60 includes remote control means 84 for moving the first locking member 62 from its second position to its first position. In the example shown in FIG. 6, the means includes a flexible wire 86 whose forward tip is connected to the rotary shaft member 70 of the first locking member. The flexible wire leads to the usual operator's station for connection with a remotely disposed control arrangement 87 as shown in FIGS. *7a* and *7b*. The control arrangement includes an operating lever 88 which is rockably mounted at its lower end to a housing 90. A J-shaped guide slot 92 is defined in the top wall of the housing, while the operating lever extends upwardly through the guide slot and exteriorly of the housing. In addition, a tension spring 94 is connected between the operating lever and the housing in order to bias the lever in a clockwise direction when viewing FIG. *7a*, and upwardly when viewing FIG. *7b*. Thus, the operating lever may be held in a position shown by the solid lines or in the position shown in the phantom lines. When the operating lever is manually moved forwardly from the phantom line to the solid line positions, then the flexible wire 86 transmits corresponding movement to the first locking member 62 so that it may be pivotally moved from the second or disengaged position shown by the solid lines in FIG. 3 to its first or engaged position shown by the phantom lines. Conversely, when the operating lever is moved rearwardly then the first locking member is pivotally moved from its engaged to its disengaged position. Furthermore, when the first locking member 62 is pivotally moved in a counterclockwise direction from its first to its second position due to the action of the release members 82 or the action of the tip cam surface 80 of the second locking member 64, then the operating lever is correspondingly pivotally moved in the counterclockwise direction to be locked to the housing in the phantom line position shown in FIG. *7a*.

In operation, the hitch 4 may be shifted from a collapsed condition as shown in solid lines in FIG. 3 to an over-center condition as shown in solid lines in FIG. 4. When the tilt links 8 are moved rearwardly back from the solid line position shown in FIG. 3, the hitch is pivotally rocked about a pivot axis or joint $P_2$ defined between the lower end portions of the lower link members 13 and the lift arms 6, to a phantom line condition designated by the letter A. While the first locking member 62 would normally remain in the disengaged second position as shown in solid lines, if it were in its engaged position shown in phantom lines, the cam surfaces 80 of the second locking member 64 would contact the engaging pin members 74 to thereby automatically reposition the first locking member 62 in a counterclockwise direction back to its disengaged postion. During such circumstances, the stop element 78 will contact the top surfaces of the lift arms so that further counterclockwise rotation thereof is prevented.

When the tilt links 8 are further tilted back from the phantom line position designated by the letter A, then the lower link members remain still, while the upper link members 15 are pivotally rocked about the pins 16 to the phantom line condition designated by the letter B. Such counterclockwise movement of the upper link members about the pivot axes or joints $P_1$ brings the hitch 4 into an over-center condition. In such over-center condition, the middle joint $P_1$ is positioned forwardly of the line connecting the lower joint $P_2$ between the lower end portions of the lower link members and the lift arms 6, to the upper joint or axis $P_3$ between the upper end portions of the upper link members and the tilt links. When the hitch assumes this over-center condition, it is to be noted that a stop element 96 secured to each of the upper link members contacts a corresponding stop block element 98 secured to the lift arms, so that the pivotal movement of the upper part of the hitch about the joint $P_1$ is limited to the desired extent. When the tilt links are subsequently tilted forwardly in such condition, then the hitch in its entirety is pivotally moved in the clockwise direction about the lower joint $P_2$ while maintaining the over-center condition.

Turning now to FIG. 4 and to the case where the hitch 4 is shifted from its over-center condition to its collapsed or bent condition, the operating lever 88, shown in FIGS. *7a* and *7b* is initially manually moved forwardly. Simultaneously therewith, the first locking member 62 is shifted from its disengaged second position as shown in phantom to its engaged first position shown in solid lines. Thus, the first locking member will engage the second locking member 64 and lock the lower link members 13 to the lift arms 6. Thereafter, when the tilt links 8 are tilted forwardly, the upper link members 15 pivot forwardly about the joints $P_1$ in the clockwise direction to the phantom line condition designated by the letter A, so that the hitch is collapsed. With such movement, the cam surfaces 83 which are associated with the upper link members contact the pin members 74 to rock the first locking members 62 back to their second or phantom line positions so that they are released from the second locking members 64. Further forward extension of the tilt links to the phantom line position designated by the letter B will relocate the hitch arrangement as a unit in its collapsed condition in the clockwise direction about the lower joint $P_2$.

Reference is now made to FIG. 8 and the construction of the hook arrangement 10 which is secured to the bucket 11. In the embodiment shown, the hook arrangement includes a pair of hook members 100 which are welded or otherwise secured to the rear surfaces of the bucket at laterally spaced apart locations. Each of the hook members has a lower receiving portion or a hook 102, an upper receiving portion or hook 104, and an intermediate receiving portion 106. The lower hook 102 includes an upwardly opening rectangularly cross section groove 108 which is adapted to closely receive the substantially rectangular cross section shape of the lower engaging member 20 from above. A pair of facing abrasion-resistant wear plates 110 should preferably be secured to the opposite walls of the groove. Likewise, the upper hook 104 includes a downwardly opening groove 112 of a semi-circular cross sectional shape which is adapted to closely accommodate the cylindrical cross sectional shape of the upper engaging member 24. The intermediate receiving portion 106 has an engaging upper surface 114 which is inclined upwardly and forwardly so as to accommodate the inclined engaging undersurface 30 of the hitch 4 when the hitch is coupled to the hook arrangement.

In order to couple the hitch 4 to the hook arrangement 10, the hitch is brought into its collapsed condition as shown by solid lines in FIG. 3. Then, due to the forward movement of the vehicle and suitable manipulation of each of the lift arms 6, the upper engaging member 24 is inserted upwardly into the upper groove 112 in the upper hook 104. As a result the hitch assumes the phantom line position designated by the letter A in FIG. 9. Thereafter, when the tilt links are tilted back, the hitch assumes a position corresponding to phantom line A in FIG. 3, and further corresponding to phantom line B in FIG. 9. When the tilt links are additionally tilted rearwardly, the hitch is shifted from such intermediate condition to an over-center condition as previously described and as shown by phantom line B in FIG. 3. When hitch reaches such over-center condition, the lower engaging member 20 is guidingly inserted into the grooves 108 of the lower hooks 102, while the intermediate engaging members 28 engage the upper surfaces 114 of the hook arrangement. As a consequence of such action, the hitch and the hook arrangement assume the position shown by the solid lines in FIG. 9. Due to the engagement of the upper surface of the upper engaging member 24 with the bottom surface of the upper groove, as well as due to the engagement of the surfaces 30 and 114, positive vertical coupling therebetween is assured. Moreover, the hitch is positively coupled to the hook arrangement in the longitudinal direction as well due to the engagement of the opposite side surfaces of the upper engaging members 24 with the side surfaces of the upper hooks 104, as well as due to similar engagement of the opposite side surfaces of the lower engaging members 20 with the opposite side surfaces of the lower hooks 102.

In accordance with one aspect of the invention, the hitch 4 is advantageously maintained in its over-center condition, wherein the joint $P_1$ is positioned forwardly of the plane connecting the joints $P_2$ and $P_3$, so that there is no danger of the hitch being inadvertently shifted into its collapsed condition. Preferably, the spring means 32 in effect exerts a predetermined amount of tension between the lower link members 13 and the upper link members 15 in such over-center condition, which force must be overcome to collapse the hitch, so that the hitch is positively coupled to the hook arrangement. Accordingly, the quick coupler of the present invention permits quick and positive connection of the hitch to the hook arrangement. Importantly, even if wear is experienced between the engaging members and the receiving portions of the hook arrangement after a long period of service, such wear may be compensated for by the engagement of the surfaces 30 and 114 so that the hitch may still be tightly coupled to the hook arrangement at all times. Even if wear is experienced in the wall surfaces of the upper groove 112 or in the upper surface 114 of the intermediate receiving portion 106, the intermediate engaging member 28 of the hitch would be moved forwardly to the phantom line position shown in FIG. 9. In other words, the hitch assumes a position such that the distance X between the joint $P_1$ and the plane connecting the joint $P_2$ and joint $P_3$ is increased to X' as shown. Because of such relationship, it will be appreciated that wear of the walls of the upper groove 112 or the upper surface 114 may be compensated for, thereby precluding disengagement of the engaging members of the hitch with the receiving portions of the hook, and resulting in greater safety.

In order to release the hitch 4 from the hook arrangement 10, the tilt links 8 are first tilted back so as to pivotally rock both of them in a counterclockwise direction about the joint $P_2$ so that the solid line position shown in FIG. 4 is assumed. Then, the operating lever 88 of FIG. 7*a* and 7*b* is manually moved forwardly so that the first locking member 62 is shifted from its disengaged second position in FIG. 4 in a clockwise direction to its first position as shown in solid lines. Therefore, the first locking member is engaged with the second locking member 64, so that the lower link members 13 are lockably secured to the lift arms 6. When the tilt links 8 are thereafter tilted forwardly, the upper link members 15 are pivotally moved in a clockwise direction about the joint $P_1$ to the phantom line A position and the lower link members are subsequently automatically released form their locked condition. Simultaneously, the lower engaging members 20 of the hitch are detached from the lower hooks while the undersurfaces 30 of the intermediate engaging members 28 are separated from the upper surfaces 114 of the hook arrangement, so that the hitch is brought into the condition shown by phantom line B in FIG. 9. Thereafter, due to manipulation of the lift arms and the rearward movement of the vehicle, the upper engaging members 24 may be disengaged from the upper hooks 104 so that the hitch is completely released from the hook arrangement.

DESCRIPTION OF AN ALTERNATE EMBODIMENT

Figure 9:
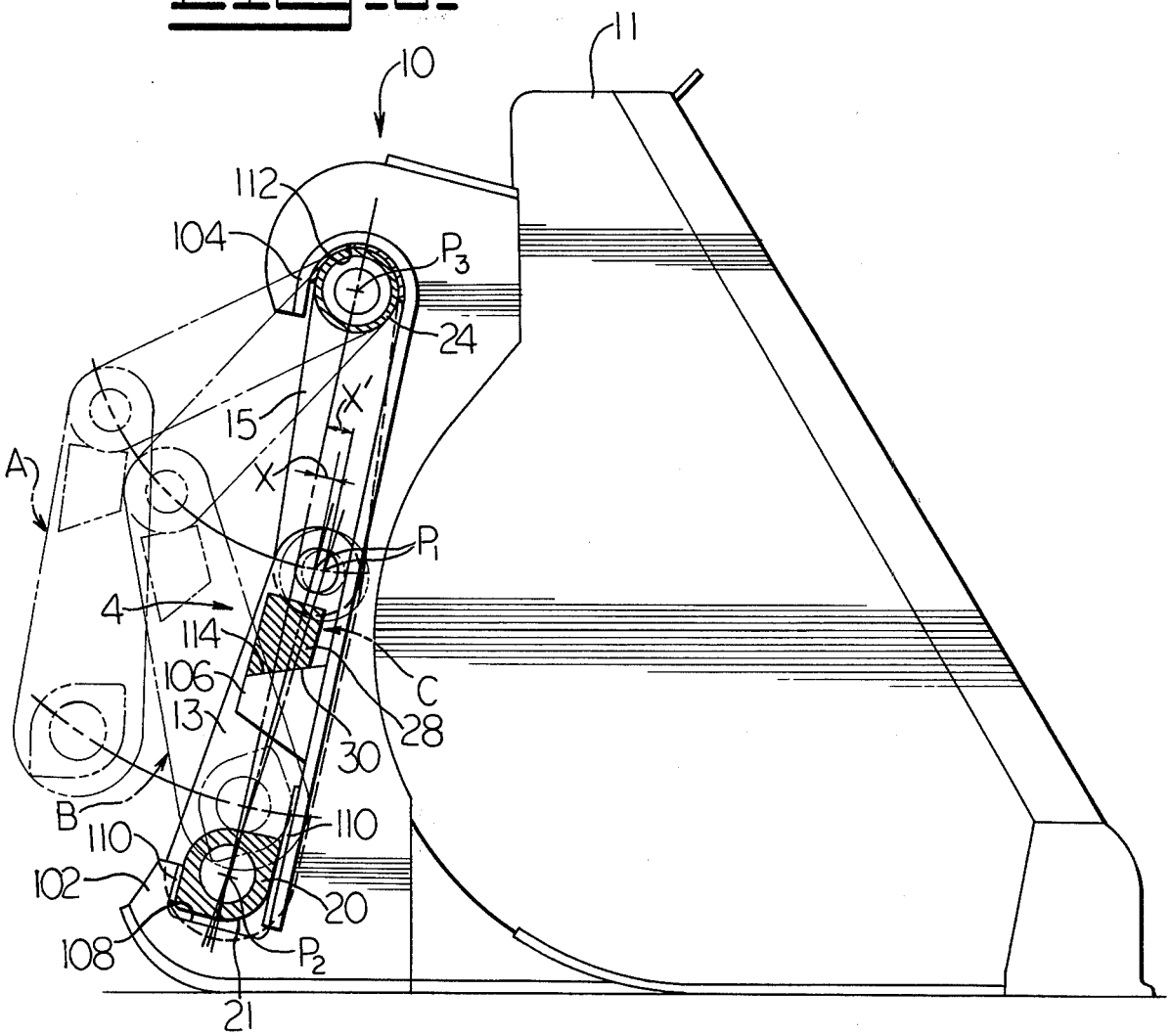
FIG. 9 is a diagrammatic and cross sectional view of the quick coupler shown in FIG. 1 to better illustrate certain operating conditions of the hitch and hook arrangement during coupling and uncoupling thereof.

FIGS. 10*a* and 10*b* show a modification of the quick coupler of the present invention, whose lower engaging members 115 are different from the lower engaging members 20 previously described in connection with FIG. 9. When the lower engaging members 20 are inserted in the grooves 108, considerable wear of the arcuate surfaces 21 as well as the side surfaces of the grooves may take place due to relative movement therebetween involving substantially line contact wear. The alternate embodiment construction shown in FIGS. 10*a* and 10*b* is intended to minimize such wear.

In the alternate embodiment, a bearing member 116 and a bearing member 118 are secured to the lower end portions of the lower link members 13, and a short shaft 120 is journalled in these bearing members. The lower engaging members 115, which have a generally square cross section, are mounted on the short shafts so that they are free to rotate relative to the lower link members. As can be readily appreciated when viewing FIG. 10*a*, when the lower engaging members 115 are inserted into or detached from the grooves 108 in the lower hooks 102, the flat surfaces of the lower engaging members are automatically moved relative to the sidewalls of the groove in surface-contacting relation with a greater area of contact. With such construction, the wear of these opposed surfaces is considerably reduced.

While the present invention has been described with respect to specific details of certain embodiments thereof, it is not intended that such details be limitations upon the scope of the invention except in so far as set forth in the appended claims.

The embodiments of the invention in which an exclusive property or privilege is claimed are defined as follows:

1. A quick coupler for attaching and detaching an implement to and from a vehicle equipped with a lift arm and a tilt link, comprising:

a hitch including a lower supporting assembly having a lower engaging member and being pivotally connected to said lift arm, an upper supporting assembly having an upper engaging member and being pivotally connected to said tilt link, said lower and upper supporting assemblies being pivotally connected and moveable between an over-center locking position and an angularly collapsed and disengaged position, and having means for urging said lower and upper supporting assemblies together, said lower engaging member being freely rotatably supported on said lower supporting assembly and having a substantially rectangular cross sectional configuration; and a hook arrangement secured to the implement and having a lower hook portion and an upper hook portion respectively receiving said lower and upper engaging members therein with said means maintaining said upper and lower supporting assemblies at said over-center locking position.

2. A quick coupler for attaching and detaching an implement to and from a vehicle equipped with a lift arm and a tilt link, comprising:

a hitch including a lower supporting assembly having a lower engaging member and being pivotally connected to said lift arm, an upper supporting assembly having an upper engaging member and being pivotally connected to said tilt link, said lower and upper supporting assemblies being pivotally connected and moveable between an over-center locking position and an angularly collapsed and disengaged position, and having means for urging said lower and upper supporting assemblies together, said lower engaging member having a substantially rectangular cross sectional configuration including a pair of diagonally opposite corners formed into arcs of an inscribed circle to provide arcuate corner surfaces thereat; and a hook arrangement secured to the implement and having a lower hook portion and an upper hook portion respectively receiving said lower and upper engaging members therein with said means maintaining said upper and lower supporting assemblies at said over-center locking position.

3. A quick coupler for attaching and detaching an implement to and from a vehicle equipped with a lift arm and a tilt link, comprising:

a hitch including a lower supporting assembly having a lower engaging member and being pivotally connected to said lift arm, an upper supporting assembly having an upper engaging member and being pivotally connected to said tilt link, said lower and upper supporting assemblies being pivotally connected and moveable between an over-center locking position and an angularly collapsed and disengaged position, and having means for urging said lower and upper supporting assemblies together;

a hook arrangement secured to the implement and having a lower hook portion and an upper hook portion respectively receiving said lower and upper engaging members therein with said means maintaining said upper and lower link members at said over-center locking position;

a locking mechanism including first and second locking members, said first locking member being connected to said lift arm and being movable between a locking position and a disengaged position, said second locking member being fixedly connected to said lower supporting assembly, said first locking member being of a construction sufficient for engaging and interlocking with said second locking member holding said lower supporting assembly in a predetermined relationship with respect to said lift arm in said locking position, and wherein said locking mechanism includes an operating lever and mechanical means for selectively moving said locking member between said positions in response to movement of said operating lever and for moving said operating lever in response to movement of said locking member; and cam surface means on said second locking member for automatically moving said first locking member back to said disengaged position upon rearwardly retracting said tilt link.

4. The quick coupler of claim 3 wherein the locking mechanism includes a releasing member mounted on said upper supporting assembly for moving said first locking member to said disengaged position upon forward extensive movement of said tilt link and after a predetermined amount of relative angular movement between said lower and upper supporting assemblies.

5. A quick coupler for attaching and detaching an implement to and from an earthmoving vehicle equipped with a pair of lift arms and a pair of tilt links, comprising:

a hitch including a pair of lower link members which are pivotally connected at the lower ends to said lift arms, a pair of upper link members which are pivotally connected at their upper ends to said tilt links and at their lower ends to the upper ends of said lower link members, a lower engaging member connected to said lower link members, an upper engaging member connected to said upper link members, and a pair of intermediate engaging stop block members individually connected to said lower link members and having a downwardly facing inclined surface; and a hook arrangement secured to the implement and including a pair of lower receiving portions having upwardly opening grooves receiving said lower engaging members from above, a pair of upper receiving portions having downwardly opening grooves receiving said upper engaging members from below, and a pair of intermediate receiving stop block portions individually having an upwardly facing inclined surface respectively making positive contact with said downwardly facing inclined surfaces of said intermediate engaging stop block members and being of a construction to define a positively locked over-center position between said lower and upper link members.

* * * * *